US005900083A

United States Patent [19]

Reed et al.

[11] Patent Number: 5,900,083

[45] Date of Patent: May 4, 1999

[54] HEAT TREATMENT OF CAST ALPHA/BETA METALS AND METAL ALLOYS AND CAST ARTICLES WHICH HAVE BEEN SO TREATED

[75] Inventors: Dale Scott Reed, Monroe; Floyd Grant Felzien, West Carrollton, both of Ohio

[73] Assignee: The Duriron Company, Inc., Dayton, Ohio

[21] Appl. No.: 08/841,462

[22] Filed: Apr. 22, 1997

[51] Int. Cl.[6] ..... C22F 1/18

[52] U.S. Cl. ..... 148/672

[58] Field of Search ..... 148/538, 672, 148/668, 669, 670, 671

[56] References Cited

U.S. PATENT DOCUMENTS

| | | | |
|---|---|---|---|
| 3,598,168 | 8/1971 | Clark | 164/51 |
| 3,665,083 | 5/1972 | Clark | 13/26 |
| 4,505,764 | 3/1985 | Smickley et al. | 148/421 |
| 4,521,259 | 6/1985 | Eucken | 148/20.3 |
| 4,636,267 | 1/1987 | Jacobsen et al. | 148/133 |
| 4,923,513 | 5/1990 | Ducheyne et al. | 148/421 |
| 5,108,517 | 4/1992 | Kimura et al. | 148/11.5 R |
| 5,125,986 | 6/1992 | Kimura et al. | 148/670 |
| 5,188,676 | 2/1993 | Taylor | 148/217 |
| 5,194,101 | 3/1993 | Worcester et al. | 148/671 |
| 5,478,419 | 12/1995 | Dumas et al. | 148/672 |

FOREIGN PATENT DOCUMENTS 817089 3/1981 U.S.S.R. .

OTHER PUBLICATIONS

C.M. Schwartz and M.W. Mallett, "Observations On The Behavior Of Hydrogen In Zirconium" Mar. 23, 1953 pp. 1–13.

*Primary Examiner*—John Sheehan

*Attorney, Agent, or Firm*—Killworth, Gottman, Hagan & Schaeff, L.L.P.

[57] ABSTRACT

A cast article is heat treated by vacuum annealing at an annealing temperature above the alpha/beta transition temperature of the cast article. Further, the cast article is subjected to a hot isostatic pressing step and a post-weld stress relief processing step. The vacuum annealing step is executed prior to the hot isostatic pressing step and the hot isostatic pressing step is executed prior to the post-weld stress relief processing step. The resulting impact resistance of the heat treated cast article, as measured by the Charpy test, represents an increase of approximately 50–200%, as compared to the untreated cast article. Further, even where the article is subjected to a post-HIP anneal the impact resistance increases by approximately 10–50%.

13 Claims, 1 Drawing Sheet

HEAT TREATMENT OF CAST ALPHA/BETA METALS AND METAL ALLOYS AND CAST ARTICLES WHICH HAVE BEEN SO TREATED

BACKGROUND OF THE INVENTION

The present invention relates to a method of heat treating cast articles and to cast articles which have been so treated. More particularly, the present invention relates to a heat treatment process for increasing the impact resistance of metal and metal alloy castings by removing hydrogen from the casting, and to the improved metal and metal alloy casting so produced.

Cast materials having desirable attributes, e.g., corrosion resistance, are often not available for some practical applications because the applications require impact resistances beyond conventionally available ranges. Further, the process of casting a material commonly reduces the impact resistance of the material utilized to form the casting. Accordingly, there is a need for a heat treatment process whereby the impact resistance of selected cast articles can be increased beyond the bounds set by conventional casting and heat treatment processes.

Some conventional heat treatment processes include a hot isostatic pressing step followed by a post-weld stress relief step. Unfortunately the post-weld stress relief step frequently reduces the impact resistance of the cast article. Accordingly, there is a further need for a heat treatment process which eliminates or reduces the loss in impact resistance commonly resulting when a post-weld stress relief step follows a hot isostatic pressing step.

BRIEF SUMMARY OF THE INVENTION

These needs are met by the present invention wherein a heat treated cast article of improved impact resistance is provided by a heat treating process incorporating a vacuum annealing step wherein the cast article is annealed at an annealing temperature above the crystal structure transition temperature of the cast article. In one embodiment of the present invention a cast article is annealed at the specified annealing temperature prior to a post-weld stress relief processing step to eliminate the typical adverse effects of the stress relief step.

In accordance with another embodiment of the present invention, a method of heat treating a cast article is provided comprising the steps of providing a cast article having an alpha/beta crystal structure transus characterized by an alpha/beta transition temperature and vacuum annealing the cast article at an annealing temperature above the alpha/beta transition temperature, wherein the annealing temperature is maintained for a duration sufficient to remove hydrogen from the cast article.

The cast article may be subject to a hot isostatic pressing step prior to the vacuum annealing step such that the cast article is characterized by a post-HIP impact resistance following the hot isostatic pressing step. The annealing temperature is maintained for a duration of time sufficient to produce a heat treated cast article characterized by an increased impact resistance at least approximately 10% greater than post-HIP impact resistance.

The cast article may be further subjected to a hot isostatic pressing step, wherein the vacuum annealing step is executed prior to the hot isostatic pressing step. Additionally, the cast article may be subjected to a post-weld stress relief processing step, wherein the vacuum annealing step is executed prior to the post-weld stress relief processing step. As a further alternative, the cast article may be subjected to a hot isostatic pressing step and a post-weld stress relief processing step, wherein the vacuum annealing step is executed prior to the hot isostatic pressing step and wherein the hot isostatic pressing step is executed prior to the post-weld stress relief processing step.

The cast article, which typically comprises a casting, may comprise zirconium or a zirconium alloy and the annealing temperature may be at least about 1600° F. (870° C.). The vacuum annealing step is preferably executed under a vacuum of approximately $5*10^{-5}$ Torr ($6.65*10^{-3}$ Pa) for a duration of approximately 2 hours but may be executed at a variety of vacuum levels and durations depending upon the nature of the desired results. For example, it is contemplated by the present invention that the duration may be as short as 1 hour or less, depending upon a variety of system and process variables, e.g., vacuum integrity, article purity, etc. Typically, the vacuum annealing step is sufficient to reduce the hydrogen content of the cast article to below about 10 ppm.

In accordance with another embodiment of the present invention, a method of heat treating a cast article is provided comprising the steps of: providing a cast article having a crystal structure transus characterized by a crystal structure transition temperature defining a thermal transition from a first crystal structure to a second crystal structure, wherein the first crystal structure is characterized by a relatively low hydrogen diffusion rate and wherein the second crystal structure is characterized by a relatively high hydrogen diffusion rate; and vacuum annealing the cast article at an annealing temperature above the crystal structure transition temperature, wherein the annealing temperature is maintained for a duration sufficient to reduce the hydrogen content of the cast article.

In accordance with yet another embodiment of the present invention, a method of heat treating a cast article is provided comprising the steps of: providing a cast article having a crystal structure transus characterized by a crystal structure transition temperature defining a thermal transition from a first crystal structure to a second crystal structure, wherein the cast article is characterized by an initial impact resistance; and vacuum annealing the cast article at an annealing temperature above the crystal structure transition temperature, wherein the annealing temperature is maintained for a duration of time sufficient to produce a heat treated cast article characterized by an increased impact resistance at least approximately 50% greater than the initial impact resistance.

In accordance with yet another embodiment of the present invention, a method of heat treating a cast article is provided comprising the steps of: providing a cast article comprising zirconium and having an alpha/beta crystal structure transus characterized by an alpha/beta transition temperature; and vacuum annealing the cast article at an annealing temperature above the alpha/beta transition temperature, wherein the annealing temperature is at least about 1600° F. (870° C.) and is maintained for at least about 2 hours under a vacuum of approximately $5*10^{-5}$ Torr ($6.65*10^{-3}$ Pa).

In accordance with yet another embodiment of the present invention, a method of heat treating a cast article is provided comprising the steps of: providing a cast zirconium alloy having an alpha/beta crystal structure transus characterized by an alpha/beta transition temperature; reducing the hydrogen content of the cast zirconium alloy to below about 10 ppm by annealing the cast zirconium alloy at an annealing temperature above the alpha/beta transition temperature, wherein the annealing temperature is at least about 1600° F. (870° C.) and is maintained for at least about 2 hours under a vacuum of approximately $5*10^{-5}$ Torr ($6.65*10^{-3}$ Pa); subjecting the cast article to a hot isostatic pressing step; and subjecting the cast article to a post-weld stress relief processing step, wherein the vacuum annealing step is executed prior to the hot isostatic pressing step and wherein the hot isostatic pressing step is executed prior to the post-weld stress relief processing step.

In accordance with yet another embodiment of the present invention, a heat treated cast article is provided comprising a material having a crystal structure transus characterized by a crystal structure transition temperature defining a thermal transition from a first crystal structure to a second crystal structure, wherein the impact resistance of the cast article, as measured by the Charpy test, exceeds 13 ft. lb (17.7 J). Preferably, the impact resistance of the cast article comprises a value in the range from above 13 ft. lb (17.7 J) to about 20 ft. lb (27.2 J), and may exceed 20 ft. lb (27.2 J).

Accordingly, it is an object of the present invention to provide a cast article of improved impact resistance through a heat treatment process wherein the cast article is annealed at an annealing temperature above its crystal structure transition temperature. Further, there is a need for a heat treatment process which eliminates or reduces the loss in impact resistance commonly resulting when a post-weld stress relief step follows a hot isostatic pressing step.

DETAILED DESCRIPTION OF THE INVENTION

Figure 1:
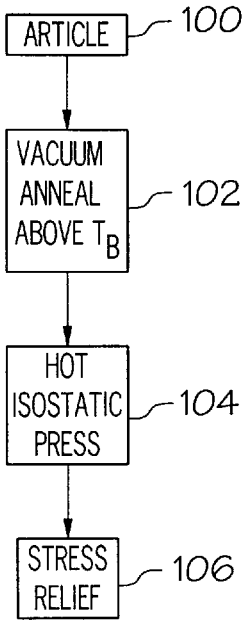
FIGS. 1 and 2 are flow charts illustrating a method of heat treating a cast article according to the present invention.
Figure 3:
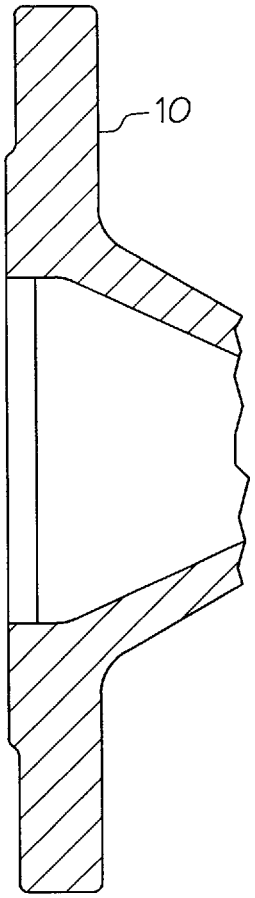
FIG. 3 is an illustration of a cast article according to the present invention.

A method of heat treating a cast article 10 according to the present invention is illustrated with reference to FIGS. 1 and 3. Initially, the cast article 10, e.g., a zirconium alloy casting, is provided, see step 100. The cast article 10 is a metal or a metal alloy having a crystal structure transus characterized by a crystal structure transition temperature defining a thermal transition from a first crystal structure to a second crystal structure. For example, the cast article 10 may comprise a zirconium casting which, at atmospheric pressure, exhibits hexagonal close packed (HCP) crystal structure below or equal to 1585° F. (863° C.), and a body centered cubic (BCC) crystal structure above 1585° F. (863° C.). For the purposes of describing and defining the present invention, it is appreciated that a casting or a cast article comprises any object which is formed by placing a fluid substance in a mold or form and allowing it to solidify.

The first crystal structure is characterized by a relatively low hydrogen diffusion rate and the second crystal structure is characterized by a relatively high hydrogen diffusion rate. For example, HCP crystal structure is characterized by a relatively low hydrogen diffusion rate and BCC crystal structure is characterized by a relatively high hydrogen diffusion rate. HCP crystal structure is referred to herein and is generally recognized in the related art as alpha crystal structure while BCC crystal structure is referred to herein and is generally in the related art as beta crystal structure. Accordingly, cast articles 10 exhibiting HCP crystal structure and BCC crystal structure on opposite sides of a crystal structure transition temperature are specifically described herein as having an alpha/beta crystal structure transus characterized by an alpha/beta transition temperature $T_\beta$, e.g., $T_\beta$=1585° F. (863° C.) for zirconium.

Referring now to step 102, the cast article 10 is vacuum annealed at an annealing temperature above its crystal structure transition temperature. As noted above, the first crystal structure is characterized by a relatively low hydrogen diffusion rate and the second crystal structure is characterized by a relatively high hydrogen diffusion rate. Accordingly, hydrogen is removed from the cast article 10 by raising the annealing temperature above the crystal structure transition temperature and by maintaining the annealing temperature in vacuo for a duration sufficient to reduce the hydrogen content of the cast article 10 to a preferred level. For example, the hydrogen content of a cast article 10 comprising cast zirconium alloy or cast zirconium is reduced to below about 10 ppm by annealing the cast article 10 at an annealing temperature above the alpha/beta transition temperature of the cast article 10. The annealing temperature, e.g. at least about 1600° F. (870° C.), is maintained for at least about 2 hours under a vacuum of approximately $5*10^{-5}$ Torr ($6.65*10^{-3}$ Pa).

TABLE 1

| HEAT # | CYCLE | H INIT. (ppm) | H FINAL (ppm) | INITIAL IMPACT (ft · lb) | FINAL IMPACT (ft · lb) |
|---|---|---|---|---|---|
| 1 | 1350° F. (566° C.) 2 Hours | 16 | 10 | 11 (15 J) | 9 (12 J) |
| 2 | 1350° F. (566° C.) 2 Hours | 23 | 23 | 8 (11 J) | 8 (11 J) |
| 3 | 1550° F. (843° C.) 4 Hours | 18 | 17 | 9 (12 J) | 9 (12 J) |
| 4 | 1550° F. (843° C.) 4 Hours | 22 | 21 | 7 (9 J) | 6 (8 J) |
| 5 | 1650° F. (900° C.) 2 Hours | 15 | 8 | 10 (14 J) | 20 (27 J) |
| 6 | 1650° F. (900° C.) 2 Hours | 16 | 7 | 7 (9 J) | 15 (20 J) |

Vacuum Level = $5*10^{-5}$ Torr; Cooling Rate <200° F./Hour

A cast article 10 treated according to the technique of the present invention exhibits increased impact resistance. For example, Table 1 illustrates the impact resistance of annealed cast Zr705C (zirconium niobium alloy—2.5% niobium), as measured by the Charpy test with a specimen size corresponding to the size established according to ASTM A-370. Heat nos. 5 and 6 correspond to the process of the present invention while heat nos. 1–4 do not correspond to the process of the present invention and are merely presented for the purpose of illustrating the increased impact resistance achieved according to the present invention. The increased impact resistance illustrated in Table 1 generally corresponds to reduced hydrogen content. This correlation supports the conclusion that hydrogen removal, facilitated by heating of the cast article 10 to a temperature above its crystal structure transition temperature, contributes significantly to the increase in impact resistance. However, the first heat illustrated in Table 1, where impact resistance did not increase with a reduction in hydrogen content, indicates that other structural characteristics or phenomena may contribute to the increased impact resistance.

Referring now specifically, to heat nos. 5 and 6 it is noted that the heat treated cast article is characterized by an increased impact resistance which is approximately 100% greater than the initial impact resistance. It is contemplated by the present invention that this increase in impact resistance is effected by a variety of system parameters, e.g., vacuum integrity, article purity, etc., and may vary from approximately 50% to over 200%, depending upon the specific system variables effecting a particular heat.

Returning now to FIG. 1, the vacuum annealing step 102, is executed prior to hot isostatic pressing (HIP), e.g., heating at 1650° F. under 15 KSI ($9.68*10^{-3}$ kg.m$^2$) isostatic pressure for 2 hours, see step 104. As is illustrated in Table 2, a less significant improvement in impact resistance is achieved if the vacuum annealing step follows HIP (post-HIP annealing). However, it is important to note that the impact resistances resulting from post-HIP annealing consistently represent improved impact resistances. Specifically, the post-HIP vacuum annealing step according to the present invention produces a heat treated cast article characterized by an increased impact resistance at least approximately 10% greater than the post-HIP, i.e., pre-anneal, impact resistance.

TABLE 2

| HEAT # | POST-HIP ANNEAL CYCLE | H INIT. (ppm) | H FINAL (ppm) | INITIAL IMPACT (ft · lb) | FINAL IMPACT (FT lbs) |
|---|---|---|---|---|---|
| 7 | 1650° F. (900° C.) 2 Hours | 18 | 12 | 10 (14 J) | 11 (15 J) |
| 8 | 1650° F. (900° C.) 2 Hours | 20 | 13 | 7 (9 J) | 10 (14 J) |
| 9 | 1650° F. (900° C.) 2 Hours | 10 | 8 | 11 (15 J) | 13 (18 J) |
| 10 | 1650° F. (900° C.) 2 Hours | 17 | 9 | 10 (13.6 J) | 12 (16 J) |
| 11 | 1650° F. (900° C.) 2 Hours | 18 | 7 | 9 (12.2 J) | 11 (15 J) |
| AVERAGE | 1650° F. (900° C.) 2 Hours | 17 | 10 | 9.4 (12.8 J) | 11.4 (15.5 J) |

Vacuum Level = $5*10^{-5}$ Torr; Cooling Rate <200° F./Hour

The HIP step 104 is followed by a conventional, e.g., 1050° F. (566° C.), post-weld stress relief heating step 106. Referring now to Table 3, sample numbers 1–3, where the vacuum annealing step of the present invention is not included in a heat treatment post-weld stress relief, the post-weld stress impact resistance of the cast article 10. reference to sample numbers 4–5, where the vacuum the present invention is included in the heat the reduction in impact resistance caused by the post-weld stress relief is eliminated.

TABLE 3

| SAMPLE # | PROCESS | H LEVEL (ppm) | IMPACT ENERGY (Ft lbs) |
|---|---|---|---|
| 1 | Casting | 42 | 7 |
| 2 | HIP'ed Casting | 52 | 7 |
| 3 | HIP + 1050° F. SR | 55 | 5 |
| 4 | VA + HIP | 12 | 12 |
| 5 | VA + HIP + 1050° F. SR | 13 | 15 |

HIP= 1650° F. (900° C.)/15 KSI ($9.68*10^{-3}$ kg · m$^2$)/2 Hours
SR= Stress Relief in Air (Air Cool)

It is contemplated by the present invention that the cast article 10 may be subject to the vacuum annealing step 102 an additional time following the HIP step 104 or the stress relief step 106.

Figure 2:
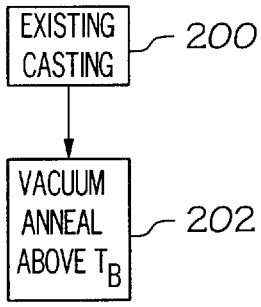

Referring now to FIG. 2, a further heat treatment process according to present invention is described. An existing casting is provided, see step 200, and vacuum annealed at a temperature above its crystal structure transition temperature in the manner described above with reference to step 102 of FIG. 1, see step 202. In this manner, the impact resistance of an existing casting is increased according to the heat treatment process of present invention.

A heat treated cast article 10 processed according to the present invention comprises a material having a crystal structure transus characterized by a crystal structure transition temperature defining a thermal transition from a first crystal structure to a second crystal structure. The impact resistance of the cast article 10, as measured by the Charpy test, exceeds at least 13 ft. lb (17.7 J). For example, according to one embodiment of the present invention, the impact resistance of the heat treated cast article is about 20 ft. lb (27.2 J). A number of variables may effect the impact resistance attained according to the heat treatment process of the present invention, e.g., article purity, process uniformity, etc., and, accordingly, it is contemplated by the present invention that the impact resistance of the heat treated cast article 10 may comprises a value in a range from above 10 ft. lb (17.7 J) to about 20 ft. lb (27.2 J), and may exceed 20 ft. lb (27.2 J).

Having described the invention in detail and by reference to preferred embodiments thereof, it will be apparent that modifications and variations are possible without departing from the scope of the invention defined in the appended claims.

What is claimed is:

1. A method of heat treating a cast zirconium article comprising the steps of:

providing a cast zirconium article having an alpha/beta crystal structure transus characterized by an alpha/beta transition temperature;

vacuum annealing said cast zirconium article at an annealing temperature above said alpha/beta transition temperature, wherein said annealing temperature is maintained for a duration sufficient to remove hydrogen from said cast zirconium article; and subjecting said cast zirconium article to a hot isostatic pressing step, wherein said vacuum annealing step is executed prior to said hot isostatic pressing step.

2. A method of heat treating a cast zirconium article as claimed in claim 1, wherein said cast zirconium article comprises a zirconium alloy.

3. A method of heat treating a cast zirconium article as claimed in claim 1, further comprising the step of subjecting said cast zirconium article to a post-weld stress relief processing step, wherein said vacuum annealing step is executed prior to said post-weld stress relief processing step.

4. A method of heat treating a cast zirconium article as claimed in claim 1, further comprising the step of subjecting said cast zirconium article to a post-weld stress relief processing step, wherein said hot isostatic pressing step is executed prior to said post-weld stress relief processing step.

5. A method of heat treating a cast zirconium article as claimed in claim 1, wherein said annealing temperature is at least about 1600° F. (870° C.).

6. A method of heat treating a cast zirconium article as claimed in claim 1, wherein said cast zirconium article comprises a casting.

7. A method of heat treating a cast zirconium article as claimed in claim 1, wherein said vacuum annealing step is executed under a vacuum of approximately $5\times10^{-5}$ Torr ($6.65\times10^{-3}$ Pa).

8. A method of heat treating a cast zirconium article as claimed in claim 7, wherein said duration is at least about 1 hour.

9. A method of heat treating a cast zirconium article comprising the steps of:

providing a cast zirconium article having an alpha/beta crystal structure transus characterized by an alpha/beta transition temperature;

vacuum annealing said cast zirconium article at an annealing temperature above said alpha/beta transition temperature, wherein said annealing temperature is maintained for a duration sufficient to remove hydrogen from said cast zirconium article; and subjecting said cast zirconium article to a hot isostatic pressing step, wherein said vacuum annealing step is executed prior to said hot isostatic pressing step and wherein said vacuum annealing step is sufficient to reduce the hydrogen content of said cast zirconium article to below about 10 ppm.

10. A method of heat treating a cast zirconium article comprising the steps of:

providing a cast zirconium article having a crystal structure transus characterized by a crystal structure transition temperature defining a thermal transition from a first crystal structure to a second crystal structure, wherein said first crystal structure is characterized by a relatively low hydrogen diffusion rate and wherein said second crystal structure is characterized by a relatively high hydrogen diffusion rate;

vacuum annealing said cast zirconium article at an annealing temperature above said crystal structure transition temperature, wherein said annealing temperature is maintained for a duration sufficient to reduce the hydrogen content of said cast zirconium article; and subjecting said cast zirconium article to a hot isostatic pressing step, wherein said vacuum annealing step is executed prior to said hot isostatic pressing step.

11. A method of heat treating a cast zirconium article comprising the steps of:

providing a cast zirconium article having a crystal structure transus characterized by a crystal structure transition temperature defining a thermal transition from a first crystal structure to a second crystal structure, wherein said cast zirconium article is characterized by an initial impact resistance;

vacuum annealing said cast zirconium article at an annealing temperature above said crystal structure transition temperature, wherein said annealing temperature is maintained for a duration of time sufficient to produce a heat treated cast zirconium article characterized by an increased impact resistance at least approximately 50% greater than said initial impact resistance; and subjecting said cast zirconium article to a hot isostatic pressing step, wherein said vacuum annealing step is executed prior to said hot isostatic pressing step.

12. A method of heat treating a cast zirconium article comprising the steps of:

providing a cast zirconium article comprising zirconium and having an alpha/beta crystal structure transus characterized by an alpha/beta transition temperature;

vacuum annealing said cast zirconium article at an annealing temperature above said alpha/beta transition temperature, wherein said annealing temperature is at least about 1600° F. (870° C.) and is maintained for at least about 1 hour under a vacuum of approximately $5\times10^{-5}$ Torr ($6.65\times10^{-3}$ Pa); and subjecting said cast zirconium article to a hot isostatic pressing step, wherein said vacuum annealing step is executed prior to said hot isostatic pressing step.

13. A method of heat treating a cast zirconium article comprising the steps of:

providing a cast zirconium article having an alpha/beta crystal structure transus characterized by an alpha/beta transition temperature;

vacuum annealing said cast zirconium article at an annealing temperature above said alpha/beta transition temperature, wherein said annealing temperature is maintained for a duration sufficient to reduce the hydrogen content of said cast zirconium article to below about 10 ppm.

* * * * *